US007579560B2

(12) United States Patent
Choi et al.

(10) Patent No.: US 7,579,560 B2
(45) Date of Patent: Aug. 25, 2009

(54) INPUT DEVICE AND MOBILE TERMINAL HAVING THE SAME

(75) Inventors: Tae-Kyu Choi, Gyeonggi-do (KR); Wan-Joong Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 70 days.

(21) Appl. No.: 11/565,038

(22) Filed: Nov. 30, 2006

(65) Prior Publication Data

US 2007/0125628 A1 Jun. 7, 2007

(30) Foreign Application Priority Data

Dec. 5, 2005 (KR) ..... 10-2005-0117705

(51) Int. Cl.
*H01H 9/26* (2006.01)

(52) U.S. Cl. ..... 200/5 A

(58) Field of Classification Search ..... 200/6 A, 200/1 B, 4, 292, 148 B, 5 A, 61.48, 52 R, 200/61.45 R, 61.52, 6 R, 5 R; 345/156–169
See application file for complete search history.

(56) References Cited

U.S. PATENT DOCUMENTS 5,555,004 A 9/1996 Ono et al. ..... 200/6 A
5,949,325 A * 9/1999 Devolpi ..... 200/6 A
6,080,941 A * 6/2000 Yokobori ..... 200/4
6,313,826 B1 * 11/2001 Schrum et al. ..... 200/5 A
6,628,266 B1 * 9/2003 Aguilar et al. ..... 200/6 R
6,995,680 B2 * 2/2006 Fong ..... 340/686.1

FOREIGN PATENT DOCUMENTS

JP 7-064714 3/1995

OTHER PUBLICATIONS

English language Abstract of JP 7-064714.

* cited by examiner

*Primary Examiner*—Edwin A. Leon
(74) *Attorney, Agent, or Firm*—Birch, Stewart, Kolasch & Birch, LLP

(57) ABSTRACT

An input device includes a plurality of strip switches radially disposed on a board, and an adjusting stick movably mounted on the board at a central location of the radially disposed strip switches for selectively connecting the strip switches. Selective connection of the strip switches by the adjusting stick inputs signals. A pointer can be conveniently controlled. Fabrication costs and the size of a mobile terminal including such an input device are reduced.

21 Claims, 8 Drawing Sheets

INPUT DEVICE AND MOBILE TERMINAL HAVING THE SAME

This application relates to subject matter contained in priority Korean Application No. 10-2005-0117705, filed on Dec. 5, 2005, which is herein expressly incorporated by reference in its entirety.

BACKGROUND OF THE INVENTION

1. Field of the Invention

The present invention relates to an input device and a mobile terminal having such an input device. More particularly, the present invention relates to an input device capable of controlling a pointer, which minimizes the size of a terminal having such an input device, and to a mobile terminal having such an input device.

2. Background of the Invention

FIG. 1 is a perspective view illustrating a conventional mobile terminal, and FIG. 2 is a sectional view illustrating an input device taken along the line A-A of FIG. 1.

A conventional mobile terminal may include a first body 110 on which a display 112 is disposed to visually display various information, and a second body 120 mounted to the first body 110 to be opened and closed. The second body 120 has input devices 122 and 124 for inputting information, and a battery 126.

The input devices include key buttons 124 arranged so as to be exposed at a front surface of the second body 120 to allow a user to activate them, such as by pressing, and a four-directional input device 122 which may be operated in four directions (i.e., upper, lower, right and left directions).

The four-directional input device 122, as illustrated in FIG. 2, includes a button 130 having a circular shape which is configured to be pressed (entered) in four directions (i.e., upper, lower, right and left directions), a pad 132 adhered (attached) to a lower surface of the button 130, and having four operation protrusions 138 positioned on its lower surface in a circumferential direction, and four dome switches 136 disposed on a printed circuit board (PCB) 134 mounted in the second body 120. The dome switches 136 are switched (activated) when the respective operation protrusions 138 are pressed.

The conventional four-directional input device 122 is operated such that when the button 130 is pressed in a certain direction, one of the four operation protrusions 138 presses one of the four dome switches 136 to produce an input of a signal.

However, the conventional input device is only allows for input of signals with respect to the four directions. Accordingly, this limitation on the direction control causes difficulty for controlling a pointer.

The conventional input device also has complicated structure and a large volume, which results in an increase in fabricating costs and difficulty in minimizing the size of the terminal.

Another conventional input device includes an input device having a magnet sensor for sensing a direction the magnet is moved to move a pointer or input a signal. Another conventional input device includes an input device having a pressure sensor which recognizes a pressurized direction of a stick to move the pointer in a desired direction or input a signal.

However, input devices using these types of sensors require separate components, such as separate sensors, control IC, and the like, and component mounting spaces for mounting the components are also required. This results in an increase in fabricating costs and difficulty in minimization of the terminal.

SUMMARY OF THE INVENTION

Therefore, an object of the present invention is to provide an input device capable of conveniently controlling a pointer by controlling the pointer in four or more directions, and of reducing a fabricating cost and minimizing a terminal by employing a simple structure, and a mobile terminal having the same.

To achieve these and other advantages, an aspect of the present invention includes an input device having a plurality of strip switches radially disposed on a board; and an adjusting stick movably mounted on the board at a central location of the radially disposed strip switches for selectively connecting the strip switches. Selective connection of the strip switches by the adjusting stick inputs signals.

The strip switches may be strip lines formed on the board in patterns. The strip switches may include eight switches radially arranged on the board with the same interval therebetween. Each of the strip switches may include two pins arranged adjacent to each other so as to be electrically connected by the adjusting stick. The respective pins of each strip switch may be respectively connected to pins of respective adjacent strip switches via a respective common node.

The adjusting stick may include an adjusting portion moved by a user; an operating portion mounted at a lower end of the adjusting portion for electrically connecting the strip switches by movement of the adjusting portion; and a connecting portion connected between the adjusting portion and the board for supporting the adjusting portion and returning the adjusting portion to an original position.

The adjusting portion may have one of a half-spherical shape or a bar shape. The operating portion may be formed of a conductive rubber material. The operating portion may be formed as a half-spherical shape at a lower surface of the adjusting portion. The connecting portion may be formed of an elastically variable material such that one end of the connecting portion is fixed to an outer circumferential surface of the adjusting portion and the other end is fixed to the upper surface of the board to return the operating stick to the original position.

The input device may include an upper board and a lower board with an interval therebetween, the strip switches being disposed on an upper surface of the lower board, and the adjusting stick extending through a through hole formed in the upper board.

Another aspect of the present invention includes a mobile communications terminal having such an input device.

Another aspect of the present invention includes an input device having a plurality of strip switches radially disposed on a board; an operation switch disposed centrally to the strip switches; and an adjusting stick movably mounted on the board for selectively connecting the switches and pressing the operation switch. The operation switch may operate a key selected by moving a pointer.

The adjusting stick may includes an adjusting portion moved by a user; an operating portion mounted at a lower end of the adjusting portion for electrically connecting the strip switches by movement of the adjusting portion; an operation protrusion formed on the operating portion for pressing the operation switch; and a connecting portion connected between the adjusting portion and the board for supporting the adjusting portion and returning the adjusting portion to an original position.

The connecting portion may be formed of an elastically variable material such that one end is fixed to an outer circumferential surface of the adjusting portion and the other end is fixed to the upper surface of the board. The operation protrusion may protrude from the center of the operating portion, and may be configured to press the operation switch when the adjusting portion is moved downward.

Each of the strip switches may include two pins arranged adjacent to each other so as to be electrically connected by the adjusting stick. The respective pins of each strip switch may be respectively connected to pins of respective adjacent strip switches via a respective common node.

Another aspect of the present invention includes a mobile communications terminal having such an input device.

To achieve these and other advantages and in accordance with the purpose of the present invention, a mobile terminal may include a terminal main body having a display and an input device mounted in the terminal main body for inputting signals. The input device includes a plurality of strip switches radially arranged on a board, and an adjusting stick movably mounted on the board for inputting signals by selectively connecting the plurality of strip switches.

According to another aspect of the present invention, a mobile terminal may include a first body having a display, and a second body mounted at the first body to be opened and closed and having an input device mounted therein. The input device includes a plurality of strip switches radially arranged on a board, and an adjusting stick movably mounted on the board for inputting signals by selectively connecting the plurality of strip switches.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention is further described in the detailed description which follows, with reference to the following noted drawings which illustrate non-limiting examples of embodiments of the present invention, and in which like reference numerals represent similar parts throughout the drawings.

DETAILED DESCRIPTION OF THE INVENTION

Description will now be given in detail of a mobile terminal and an input device according to the present invention, with reference to the accompanying drawings.

Figure 1:
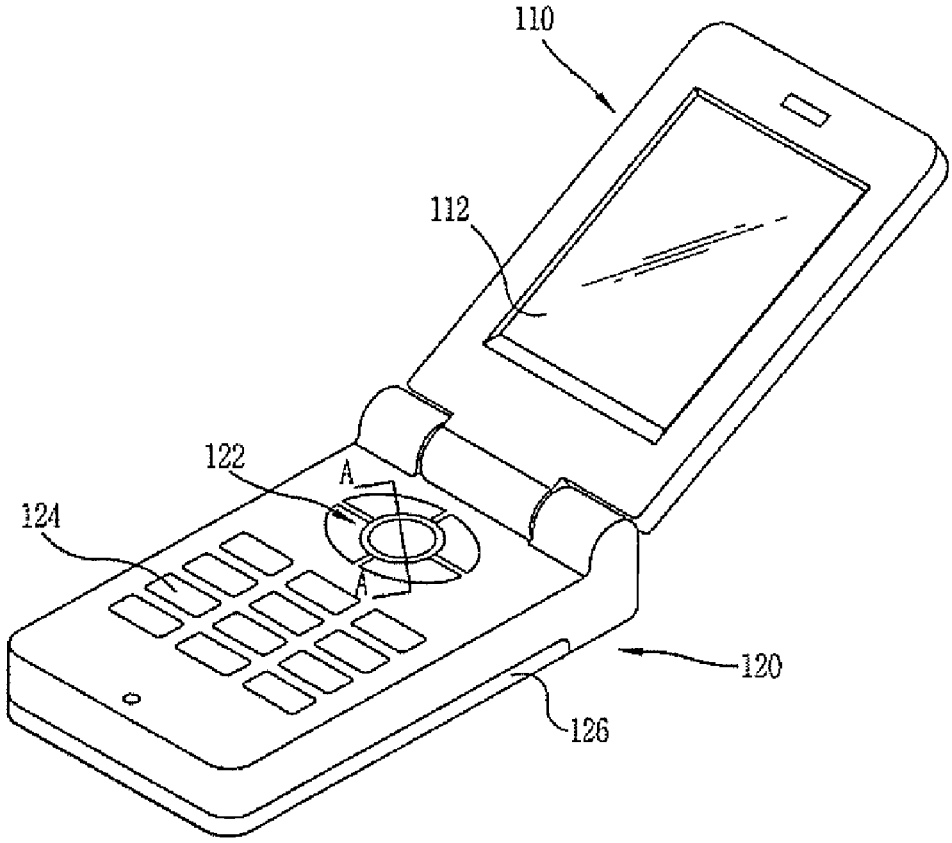
FIG. 1 CONVENTIONAL ART
FIG. 1 is a perspective view of a conventional mobile terminal.
Figure 2:
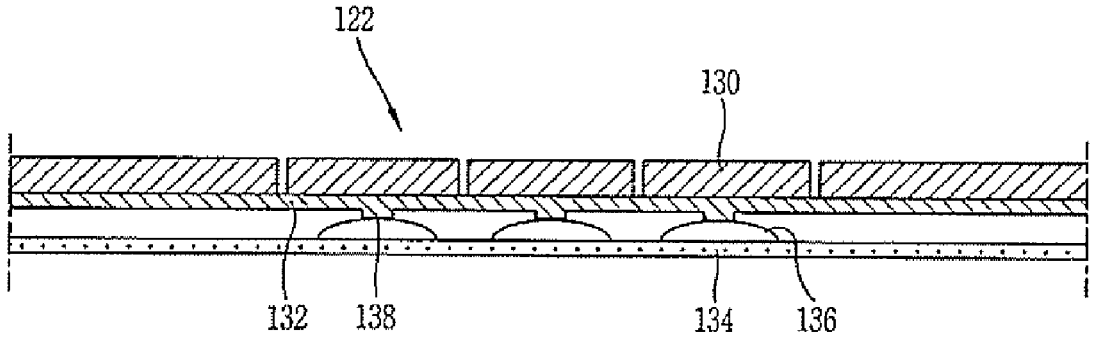
FIG. 2 CONVENTIONAL ART
FIG. 2 is a sectional view taken along line A-A of FIG. 1.
Figure 3:
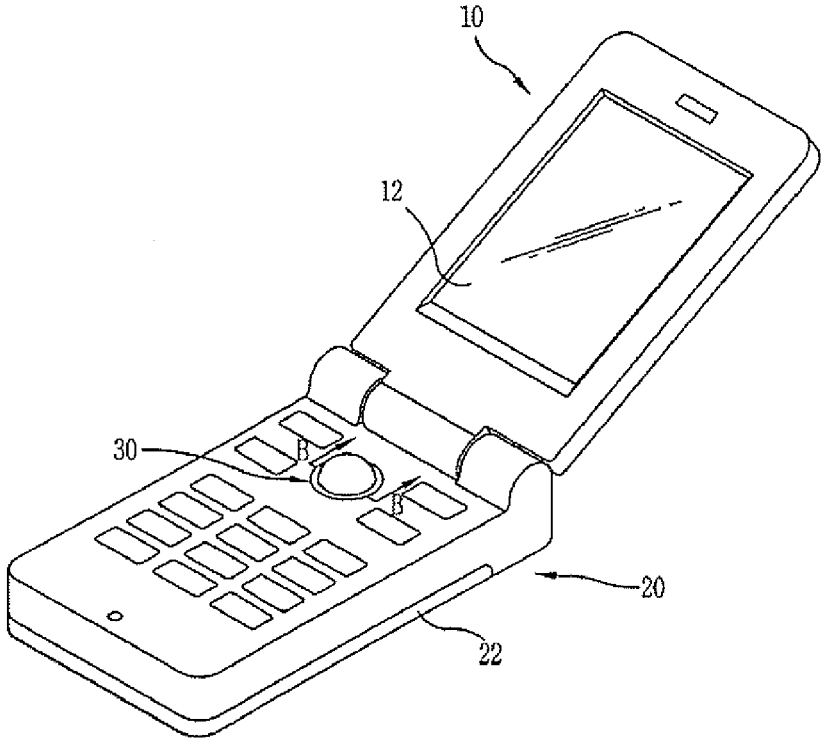
FIG. 3 is a perspective view of a mobile terminal in accordance with an embodiment of the present invention.

The input device of the present invention may be provided on various types of mobile terminals. FIG. 3 is a perspective view illustrating a mobile terminal in accordance with one embodiment of the present invention.

A mobile terminal according to the present invention includes a first body 10 having a display 12, and a second body 20 mounted to the first body 10 in such a manner as to be opened and closed, The second body 12 includes an input device 30 for inputting information, a battery 22 mounted on its rear surface, and a printed circuit board mounted therein.

The input device 30 may be provided on various types of mobile terminals, such as slide type mobile terminals in which the first and second bodies are movably connected to each other in such a manner as to be relatively slid, bar type mobile terminals in which a display and a keypad are formed on a singly body, swing type mobile terminals in which the first and second bodies are connected to each other to be relatively rotated, as well as the folder type mobile terminals shown in FIG. 3.

Figure 4:
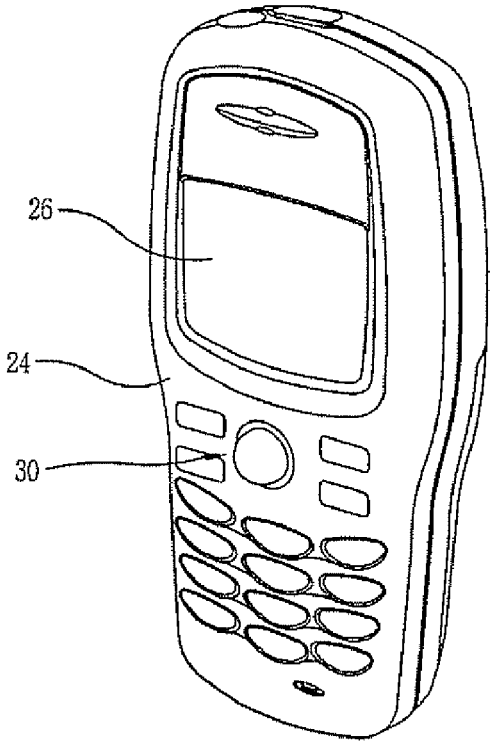
FIG. 4 is a perspective view of a mobile terminal in accordance with another embodiment of the present invention.

An input device may be provided on a bar type mobile terminal, as shown in FIG. 4. The mobile terminal includes a terminal main body 24 having a printed circuit board therein, a display 26 mounted on a front surface of the terminal main body 24 for displaying information, and an input device 30 mounted on the terminal main body 24 for inputting information.

Figure 5:
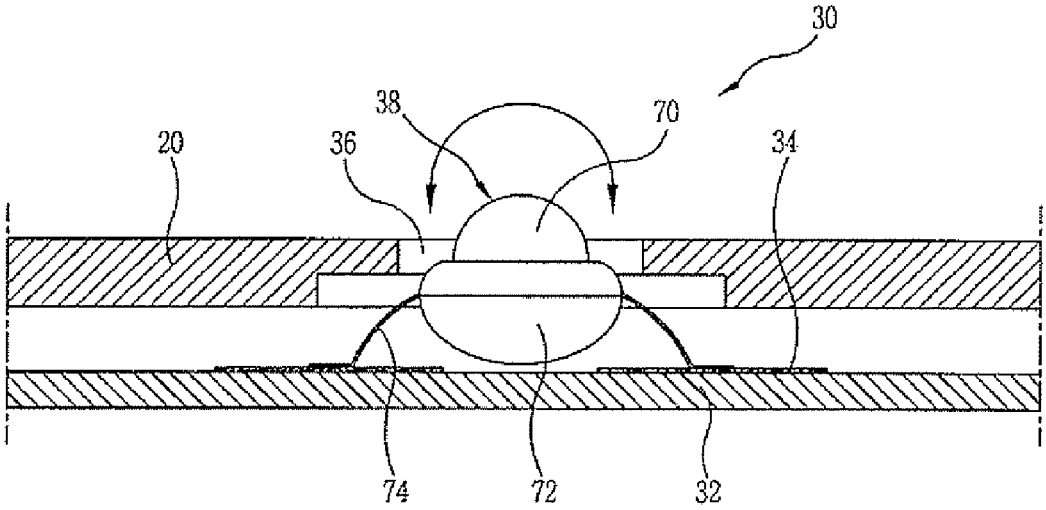
FIG. 5 is a sectional view taken along the line B-B of FIG. 3.
Figure 6:
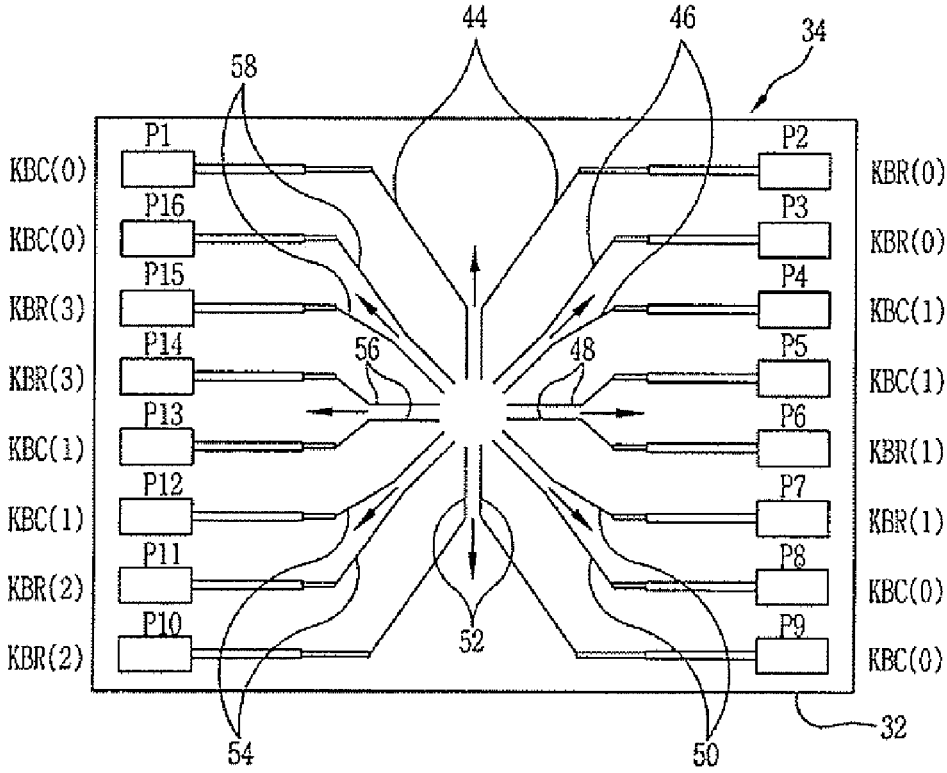
FIG. 6 is a plan view of strip switches of an input device in accordance with an embodiment of the present invention.

FIG. 5 is a sectional view of an input device in accordance with an embodiment of the present invention, and FIG. 6 is a plan view of strip switches of the input device in accordance with the embodiment of the present invention.

The input device 30 may include a board 32 provided in the second body 20 or the terminal main body 24, a plurality of strip switches 34 radially arranged on an upper surface of the board 32, and an adjusting stick 38 mounted on the board 32 and arranged to be exposed to the exterior through a through hole 36 formed in the second body 20 or the terminal main body 24. The adjusting stick 38 is configured to electrically connect the strip switches to one another in order to input signals.

The board 32 may be provided as a printed circuit board disposed in the second body 20 or the terminal main body 24, and also may be provided using a separate board to electrically connected to the printed circuit board.

The strip switches 34 are formed in a plurality of strip lines which are disposed as patterns on an upper surface of the board 32. The strip switches 34 are electrically connected to one another via a Central Processing Unit (CPU) and wires. A single strip switch 44 includes two pins which are aligned to be adjacent to each other, in order to be electrically connected to each other by the adjusting stick 38.

As shown in FIG. 6, eight strip switches 34 are radially provided so as to allow a movement of a pointer in eight directions, for conveniently controlling the pointer.

The strip switches 34 are formed by radially arranging eight switches in sequence with the same interval (gap) therebetween. The eight switches correspond to a first switch 44 arranged at an upper side and having two pins P1 and P2, a second switch 46 having two pins P3 and P4, a third switch 48 having two pins P5 and P6, a fourth switch 50 having two pins P7 and P8, a fifth switch 52 having two pins P9 and P10, a sixth switch 54 having two pins P11 and P12, a seventh switch 56 having two pins P13 and P14, and an eighth switch 58 having two pins P15 and P16.

The strip switches 34 have the structure in which each switch is radially arranged to be adjacent to another switch. Accordingly, when the adjusting stick 38 inadvertently electrically connects the pin P2 of the first switch 44 to the pin P3 of the second switch 46, the pin P3 being arranged to be adjacent to the pin P2, a malfunction could potentially occur. However, in order to prevent such a malfunction of the input device 30, the same node is used to connect the pin P2 of the first switch 44 to the pin P3 of the second switch 46.

That is, a common node is used to connect one of the pins of one switch to one of the pins of another switch, where the two pins of the different switches are adjacent to each other. In this manner, the same signal is inputted to the CPU, even if a pin of an adjacent switch is inadvertently connected by the adjusting stick 38. Accordingly, the malfunction does not occur when the two pins of the adjacent switches are electrically connected by the adjusting stick 38.

Figure 7:
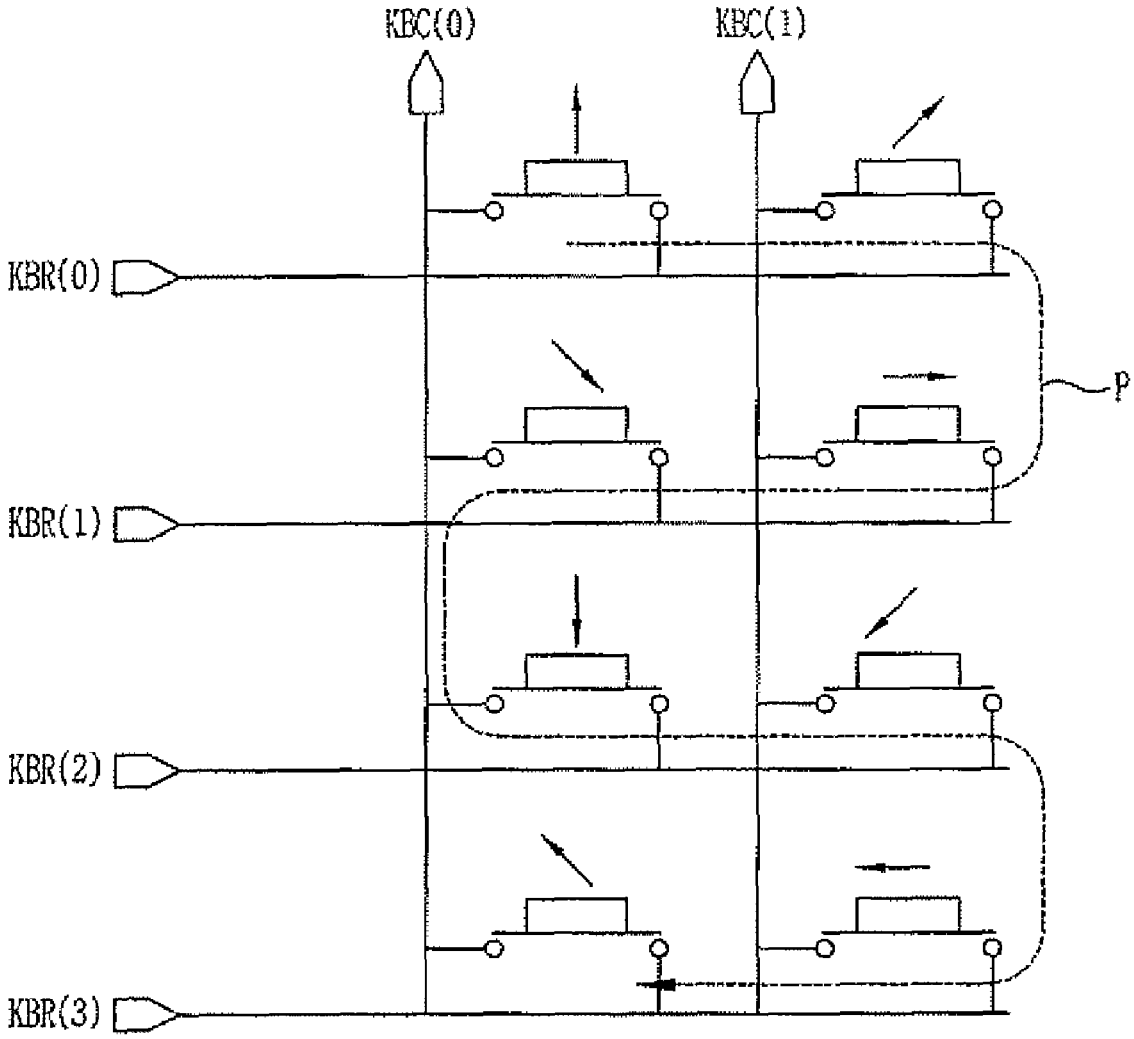
FIG. 7 shows a circuit of strip switches in accordance with an embodiment of the present invention.

A strip switch circuit is shown in FIG. 7, in which the eight strip switches are disposed on scan lines arranged in four rows in a horizontal direction and on data lines arranged in two rows in a vertical direction. The strip switches are arranged in a meandering array manner as represented by an arrow P, so as to prevent malfunction of the input device 30 as described above. The order of arranging the strip switches in the circuit illustrated in FIG. 7 are the same as that of arranging the pins of each switch in the clockwise direction as illustrated in FIG. 6.

The adjusting stick 38 includes an adjusting portion moved or adjusted by a user to input signals, an operating portion 72 disposed at a lower end of the adjusting portion 70 for electrically connecting the strip switches 34 to one another by operation of the adjusting portion 70, and a connecting portion 74 connected between the adjusting portion 70 and the board 32 for supporting the adjusting portion 70 and applying an elastic force to the adjusting portion 70 in order to return the adjusting portion 70 to its original position.

The adjusting portion 70 is arranged to be exposed to the exterior through a through hole 36 formed in the terminal main body 24. The adjusting portion may have any suitable shape, such as a half-spherical shape.

The operating portion 72 is formed of a conductive material, and is disposed at the lower surface of the adjusting portion 70. The operation portion 72 may have any suitable shape, such as a half-spherical shape. The operating portion 72 may be formed of any suitable material, such as a conductive rubber material capable of reducing a friction generated when it is in contact with the strip switches 34.

The connecting portion 74 may be formed of any suitable material, such as an elastically variable material. One end of the connecting portion 74 is fixed to an outer circumferential surface of the adjusting portion 70 and the other end thereof is fixed to an upper surface of the board 32. The connecting portion 74 is preferably formed of a non-conductive rubber material having an elastic force sufficient for returning the adjusting portion 70 to its original position.

An operation of the input device according to the present invention having such a construction will now be explained.

FIGS. 8A through 10B are views illustrating operational states of an input device in accordance with one embodiment of the present invention.

Figure 8A:
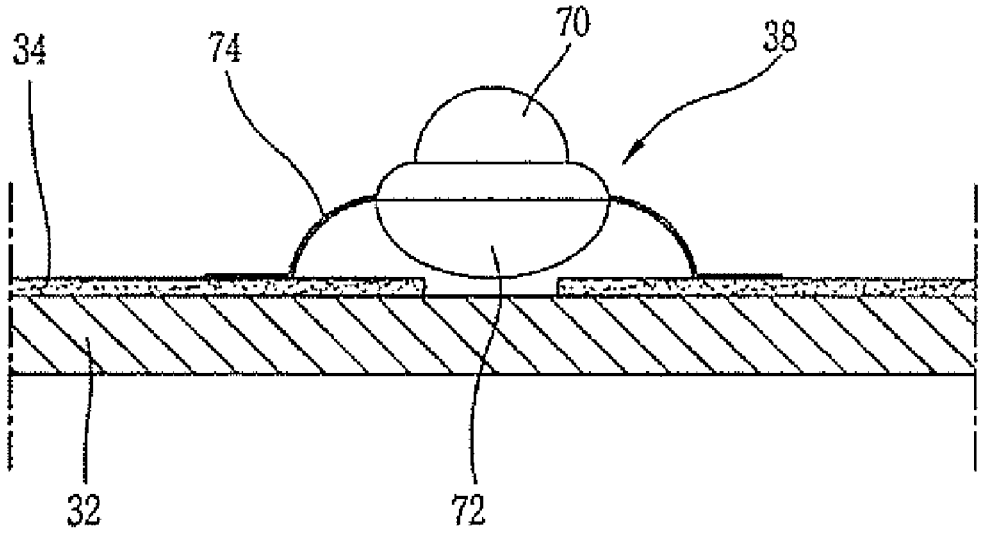
FIG. 8A is a partial side view depicting an operational state of an input device.
Figure 8B:
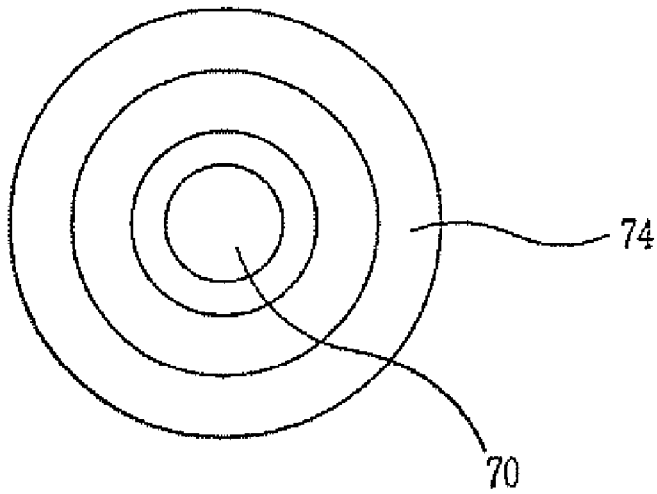
FIG. 8B is a partial plan view depicting the operational state shown in FIG. 8A.

First, as illustrated in FIGS. 8A and 8B, in a non-operated state of the adjusting stick 38, the adjusting portion 70 is positioned at the center by an elastic force of the connecting portion 74 and is not in contact with any of the strip switches 34. Accordingly, the adjusting portion 70 is in a neutral condition in which a signal is not being inputted.

Figure 9A:
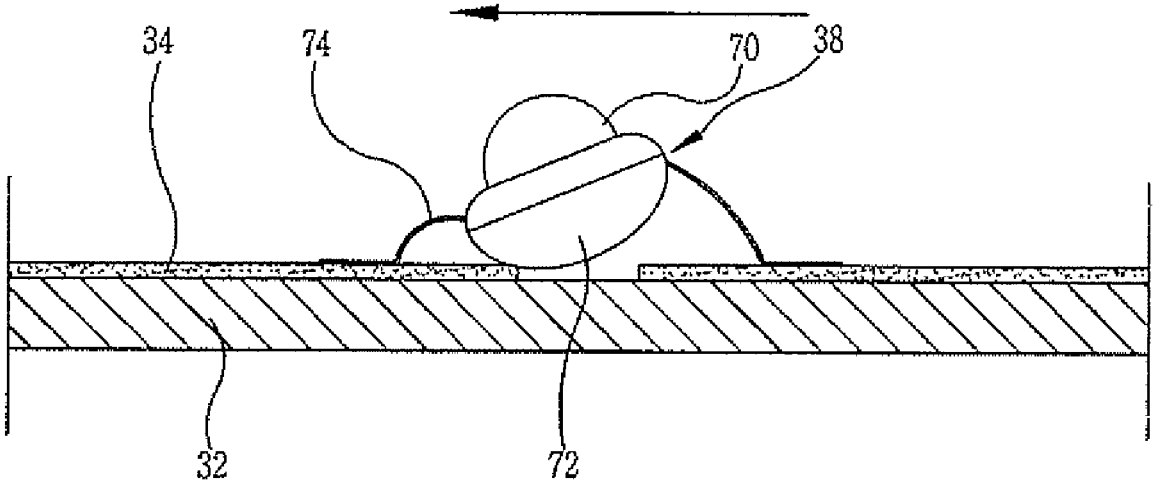
FIG. 9A is a partial side view depicting an operational state of an input device.
Figure 9B:
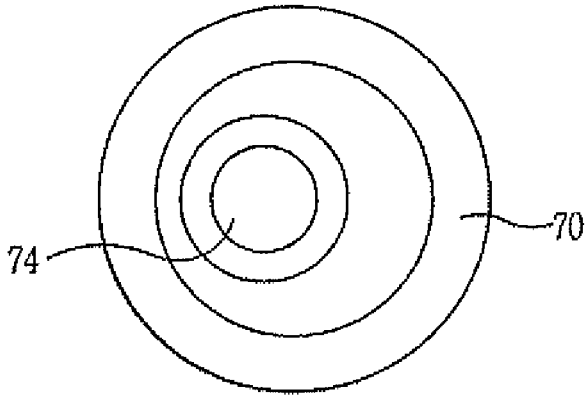
FIG. 9B is a partial plan view depicting the operational state shown in FIG. 9A.

In the state illustrated in FIGS. 9A and 9B, a user moves the adjusting portion 70 of the adjusting stick 38 to a left side in the drawing. In this condition the connecting portion 74 is elastically deformed. The operating portion 72 contacts with two pins of the seventh switch 56 to electrically connect the two pins. Accordingly, a signal of the seventh switch 56 is input and transferred to the CPU, which then converts the signal into data. The CPU permits a cursor or a pointer displayed on a display 12 to be moved toward the left side, or information to be displayed on the display 12, based upon the converted data.

Figure 10A:
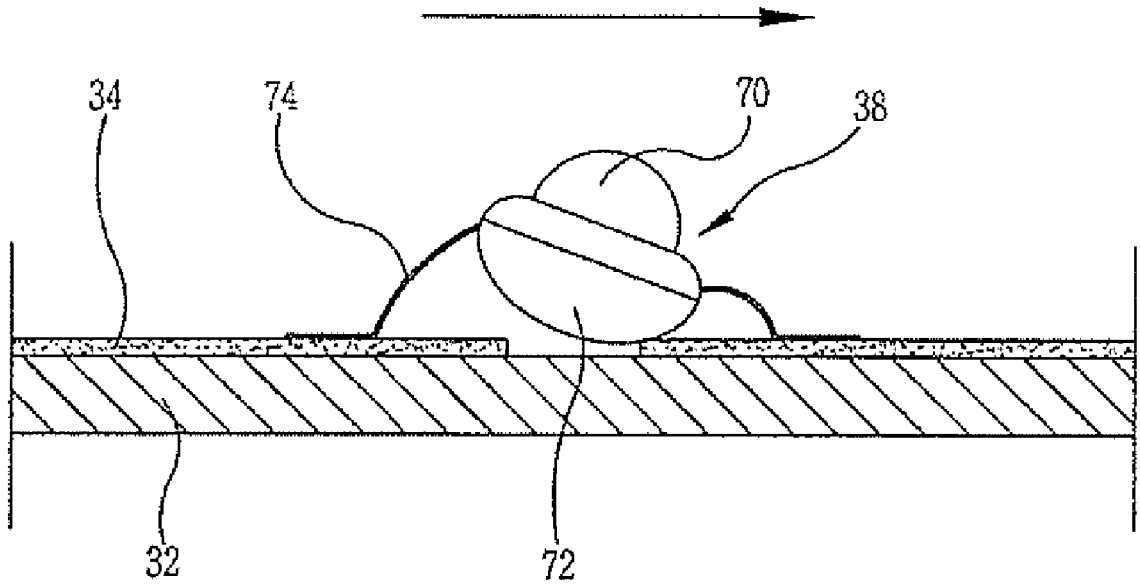
FIG. 10A is a partial side view depicting an operational state of an input device.
Figure 10B:
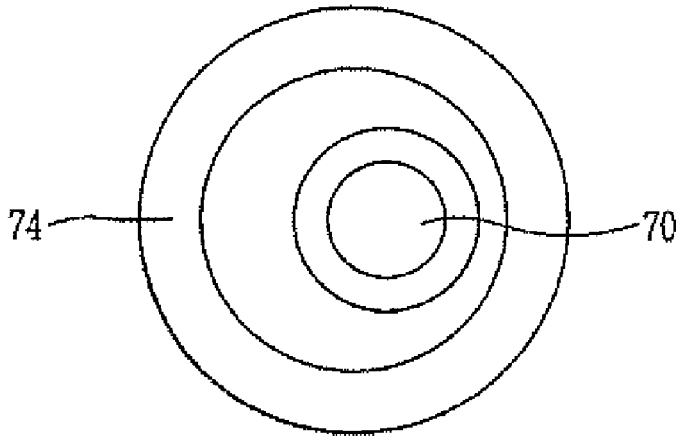
FIG. 10B is a partial plan view depicting the operational state shown in FIG. 10A.

As illustrated in FIGS. 10A and 10B, when the user moves the adjusting portion 70 of the adjusting stick 38 to a right side in the drawing, the connecting portion 74 is elastically deformed. The operating portion 72 then connects two pins of the third switch 48, and the signal of the third switch 48 is inputted to the CPU.

Thus, the cursor or pointer can be moved in the eight directions by adjusting the adjusting portion 70 in the eight directions, which makes it convenient to control the pointer.

Figure 11:
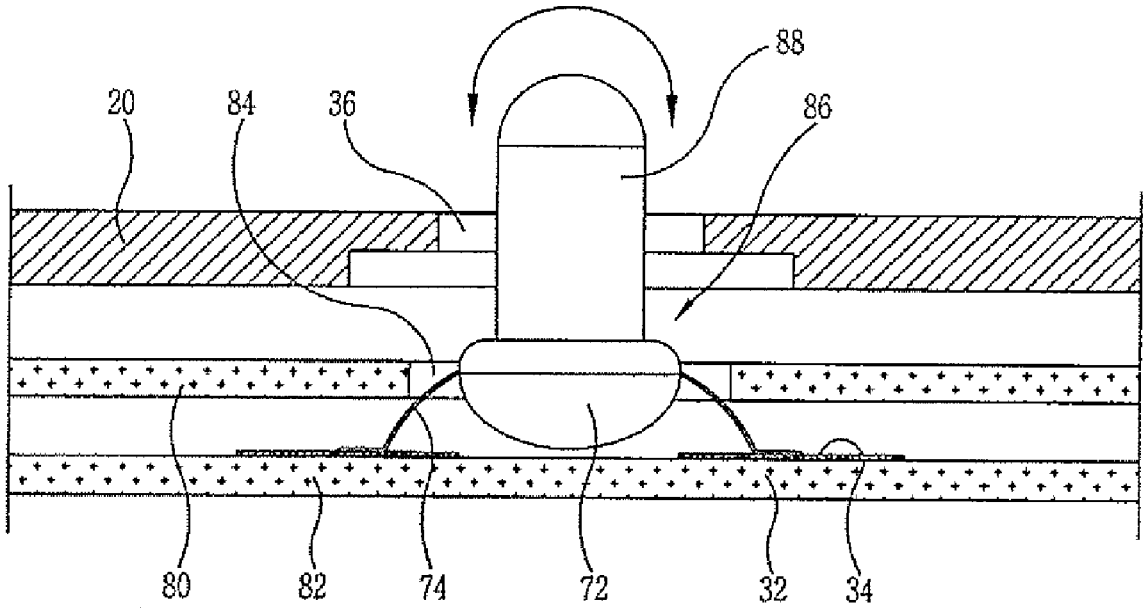
FIG. 11 is a sectional view of an input device in accordance with another embodiment of the present invention.

FIG. 11 is a sectional view of an input device in accordance with a second embodiment of the present invention.

An input device according to the second embodiment includes a first board 80 and a second board 82 stacked with a certain gap therebetween inside the second body 20 or the terminal main body 24, a plurality of strip switches 34 2o radially disposed at an upper surface of the second board 82, and an adjusting stick 86 mounted on the second board 82. The adjusting stick 86 is positioned in a through hole 36 formed in the second body 20 or the terminal main body 24, and a through hole 84 formed in the first board 80, for inputting signals by electrically connecting the strip switches 34.

The strip switches 34 have the same structure and function as the strip switches 34 described with regard to the first embodiment, explanation of which will not be repeated.

The adjusting stick 86 has the same construction as that of the adjusting stick 38 described in the first embodiment. However, since an adjusting portion 88 extends through the through hole 84 formed in the first board 80 and the through hole 36 formed in the terminal main body 24, the adjusting stick is formed as a long bar or arm. Accordingly, a range in which the adjusting portion 88 is movable is extended so as to enable a more convenient use of the adjusting portion 88.

An operation of the input device according to the second embodiment is the same as that of the input device described above with regard to the first embodiment.

Figure 12:
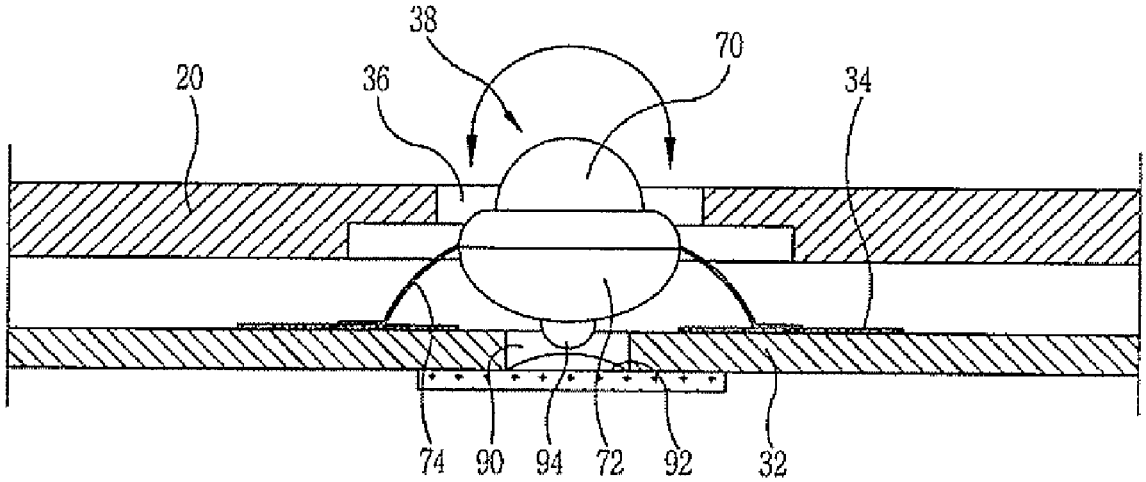
FIG. 12 is a sectional view of an input device in accordance with another embodiment of the present invention.

FIG. 12 is a sectional view of an input device in accordance with a third embodiment of the present invention.

An input device according to a third embodiment includes a plurality of strip switches 34 radially disposed on the board, an operation switch 92 formed at the center of the strip switches 34, and an adjusting stick 38 movably mounted on the board 32 for electrically connecting the plurality of strip switches 34 and for pushing (pressing, entering) the operation switch 92.

The strip switches 34 have the same structure as that of the strip switches 34 described with regard to the first embodiment, and serve to move a cursor or pointer when the adjusting stick 38 is operated or manipulated by a user.

The operation switch 92 is disposed at the center of the strip switches 34. Accordingly, when pressing the operation switch 92 by downward movement of the adjusting stick 38, the operation switch 92 serves to operate (activate) a menu selected by the movement of the cursor or pointer. The operation switch 92 may be of any suitable configuration, such as that of a dome switch.

The operation switch 92 is positioned in a through hole 90 formed in the board 32 and is arranged at a portion lower than portions where the strip switches 34 are disposed at the upper surface of the board 32.

The adjusting stick 38 includes an adjusting portion 70 adjusted to input signals, an operating portion 72 mounted at a lower side of the adjusting portion 70 for electrically connecting the strip switches 34 by operation of the adjusting portion 70, an operation protrusion 94 protrudingly formed on the operating portion 72 for operating the operation switch 92, and a connecting portion 74 connected between the adjusting portion 70 and the board 34 for supporting the adjusting portion 70 and returning the adjusting portion 70 to its original position.

The adjusting stick 38 has the same structure and function as that of the adjusting stick described with regard to the first embodiment, with the addition of the operation protrusion 94 protruded from the center of the operating portion 72 in for operating the operation switch 92.

The input device according to the third embodiment is operated as same as the input device according to the one embodiment is. However, in the input device according to the third embodiment, the operation switch 92 is operated by pushing (pressing, entering) the adjusting stick 38 downward.

As described above, in the input device having such a construction and the mobile terminal having such an input device, the strip switches constituted with eight switches are provided to conveniently control the pointer in the eight directions, and the simple structure can reduce fabrication costs.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically as described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to an exemplary embodiment, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified, Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. An input device provided in a main body comprising:

an upper board distinct from the main body and a lower board, the upper board and the lower board having a gap therebetween;

a plurality of strip switches radially disposed and connected in a meandering array on an upper surface of the lower board; and an adjusting stick extending through the main body and through a through hole in the upper board, movably mounted on the lower board at a location central to the radially disposed strip switches, and being configured to selectively connect the strip switches, wherein selective connection of the strip switches by the adjusting stick is configured to input signals.

2. The input device of claim 1, wherein the strip switches comprise strip lines formed on the board in patterns.

3. The input device of claim 1, wherein the strip switches comprise eight switches radially arranged on the board and having the same interval therebetween.

4. The input device of claim 1, wherein the input device is provided in a mobile communications terminal.

5. The input device of claim 1, wherein the lower board comprises a printed circuit board.

6. The input device of claim 1, wherein each of the strip switches includes two pins arranged adjacent to each other so as to be electrically connected by the adjusting stick.

7. The input device of claim 6, wherein the respective pins of each strip switch are respectively connected to pins of respective adjacent strip switches via a respective common node.

8. The input device of claim 1, wherein the adjusting stick includes:

an adjusting portion movable by a user;

an operating portion mounted at a lower end of the adjusting portion for electrically connecting the strip switches by movement of the adjusting portion; and a connecting portion extending between the adjusting portion and the lower board for supporting the adjusting portion and returning the adjusting portion to an original position.

9. The input device of claim 8, wherein the adjusting portion has one of a semi-spherical shape and a bar shape.

10. The input device of claim 8, wherein the operating portion is formed of a conductive rubber material.

11. The input device of claim 8, wherein the operating portion is formed as a semi-spherical shape at a lower surface of the adjusting portion.

12. The input device of claim 8, wherein the connecting portion comprises an elastic material such that one end of the connecting portion is fixed to an outer circumferential surface of the adjusting portion and the other end is fixed to the upper surface of the lower board to return the operating stick to the original position.

13. An input device provided in a main body comprising:

an upper board distinct from the main body and a lower board, the upper board and the lower board having a gap therebetween;

a plurality of strip switches radially disposed and connected in a meandering array on an upper surface of the lower board;

an operation switch disposed centrally to the strip switches; and an adjusting stick extending through the main body and through a through hole in the upper board, movably mounted on the lower board, and being configured to selectively connect the switches and pressing the operation switch.

14. The input device of claim 13, wherein the operation switch activates a function selected by movement of a pointer.

15. The input device of claim 13, wherein the input device is provided in a mobile communications terminal.

16. The input device of claim 13, wherein the lower board comprises a printed circuit board.

17. The input device of claim 13, wherein the adjusting stick includes:

an adjusting portion movable by a user;

an operating portion mounted at a lower end of the adjusting portion for electrically connecting the strip switches by movement of the adjusting portion;

an operation protrusion formed on the operating portion for pressing the operation switch; and a connecting portion extending between the adjusting portion and the lower board for supporting the adjusting portion and returning the adjusting portion to an original position.

18. The input device of claim 17, wherein the connecting portion comprises an elastic material such that one end is fixed to an outer circumferential surface of the adjusting portion and the other end is fixed to the upper surface of the lower board.

19. The input device of claim 17, wherein the operation protrusion protrudes from the center of the operating portion, and is configured to press the operation switch when the adjusting portion is moved downward.

20. The input device of claim 13, wherein each of the strip switches includes two pins arranged adjacent to each other so as to be electrically connected by the adjusting stick.

21. The input device of claim 20, wherein the respective pins of each strip switch are respectively connected to pins of respective adjacent strip switches via a respective common node.

* * * * *